US006887639B2

(12) United States Patent
Tavernier et al.

(10) Patent No.: US 6,887,639 B2
(45) Date of Patent: May 3, 2005

(54) LIQUID TONER COMPOSITION

(75) Inventors: Serge Tavernier, Lint (BE); Werner Op de Beeck, Putte (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 10/372,645

(22) Filed: Feb. 21, 2003

(65) Prior Publication Data

US 2003/0219672 A1 Nov. 27, 2003

Related U.S. Application Data

(60) Provisional application No. 60/359,530, filed on Feb. 22, 2002.

(51) Int. Cl.[7] ..... G03G 9/12

(52) U.S. Cl. ..... 430/114; 430/115; 430/117

(58) Field of Search ..... 430/114, 115, 430/117

(56) References Cited

U.S. PATENT DOCUMENTS

| | | | | |
|---|---|---|---|---|
| 3,853,778 | A | | 12/1974 | Buckley et al. |
| 4,052,325 | A | * | 10/1977 | Santilli |
| 4,252,921 | A | * | 2/1981 | Merrill et al. |
| 4,271,249 | A | | 6/1981 | Gilliams et al. |
| 4,331,755 | A | | 5/1982 | Gilliams et al. |
| 4,528,257 | A | | 7/1985 | Polderman et al. |
| 4,600,675 | A | | 7/1986 | Iwasa et al. |
| 4,940,644 | A | | 7/1990 | Matsubara et al. |
| 5,057,392 | A | | 10/1991 | McCabe et al. |
| 5,346,792 | A | | 9/1994 | Kobayashi et al. |
| 6,103,781 | A | | 8/2000 | Li et al. |
| 2001/0018157 | A1 | | 8/2001 | Aoki et al. |

FOREIGN PATENT DOCUMENTS

| | | | |
|---|---|---|---|
| EP | 307475 | A | 3/1989 |
| EP | 0495475 | B1 | 7/1992 |
| EP | 0495476 | A1 | 7/1992 |
| EP | 0384990 | B1 | 7/1993 |
| EP | 0393252 | B1 | 12/1993 |
| EP | 0384040 | B1 | 1/1994 |
| EP | 0394563 | B1 | 3/1994 |
| EP | 0400706 | B1 | 7/1994 |
| EP | 0716351 | B1 | 6/1996 |
| EP | 1088843 | A2 | 4/2001 |
| GB | 1373220 | | 11/1974 |
| GB | 1438110 | | 6/1976 |

OTHER PUBLICATIONS

Database WPI, Sechion Ch., Week 198849, Derwent Publications Ltd., London, GB, AN 1988–348824, XP002242835 & JP 63 258939 A (Nippon Styrene Paper), Oct. 26, 1988, Abstract.

Database WPI, Sechion Ch., Week 199245, Derwent Publications Ltd., London, GB, AN 1992–370570, XP002242836 & JP 04 272937 A (Toray), Sep. 29, 1992, Abstract.

Database WPI, Sechion Ch., Week 198840, Derwent Publications Ltd., London, GB, AN 1988–282685, XP002242837 & JP 63 207823 A (Toray), Aug. 29, 1988, Abstract.

European Search Report in equivalent application EP 03 44 7035.

Textbook of Polymer Science; Second Edition; "Polymer Structure and Physical Properties." John Wiley & Sons, Inc., pp. 220–252 (1962).

Shirai, et al.; NIP17: International Conference on Digital Printing Technologies; "The Toner for Low Energy Fusing by using Crystalline Polyester." pp. 354–357.

Van Krevelen; Elsevier Publishing Company; "Properties of Polymers—Correlations with Chemical Structure." pp. 386–393.

Van Krevelen; Elsevier Publishing Company; "Properties of Polymers—Correlations with Chemical Structure." pp. 130–133.

Thourson; IEEE Transactions on Electron Devices, Col. ED–19, No. 4, Apr. 1972; "Xerographic Development Processes: A Review."

* cited by examiner

*Primary Examiner*—John L Goodrow
(74) *Attorney, Agent, or Firm*—Knobbe Martens Olson & Bear LLP

(57) ABSTRACT

The present invention relates to a liquid toner composition suited for development of electrostatic charge images, magnetic patterns or DEP (Direct Electrostatic Printing). More specifically the present invention relates to a specific liquid toner composition allowing transfusing of the toner image from a temporary carrier to the final substrate at low temperature.

22 Claims, No Drawings

LIQUID TONER COMPOSITION

RELATED APPLICATION

This application claims the benefit of U.S. Provisional Application No. 60/359,530, filed Feb. 22, 2002.

FIELD OF THE INVENTION

The present invention relates to a liquid toner composition suited for development of electrostatic charge images, magnetic patterns, and Direct Electrostatic Printing (DEP). More specifically, the present invention relates to a liquid toner composition allowing transfusion of the toner image from a temporary carrier to the final substrate at low temperature.

BACKGROUND OF THE INVENTION

It is well known in the art of electrographic printing and electrophotographic copying to form an electrostatic latent image corresponding to either the original to be copied, or corresponding to digitized data describing an electronically available image.

In electrophotography, an electrostatic latent image is formed by uniformly charging a photoconductive member and image-wise discharging it by an image-wise modulated photo-exposure.

In electrography, an electrostatic latent image is formed by image-wise deposition of electrically charged particles, e.g., from electron beam or ionized gas (plasma), onto a dielectric substrate.

The latent images thus obtained are developed, i.e., converted into visible images by selectively depositing thereon light absorbing particles, referred to as toner particles, which are typically electrically charged.

In magnetography, a latent magnetic image is formed in a magnetizable substrate by a pattern-wise modulated magnetic field. The magnetizable substrate must accept and hold the magnetic field pattern required for toner development, which proceeds with magnetically attractable toner particles.

In toner development of latent electrostatic images two techniques have been applied: "dry" powder development and "liquid" dispersion development. Dry powder development is nowadays most frequently used.

In dry development, the application of dry toner powder to the substrate carrying the latent electrostatic image or magnetic image may be carried out by different methods, including "cascade", "magnetic brush", "powder cloud", "impression," and "transfer" or "touchdown" development methods. See, e.g., Thomas L. Thourson, IEEE Transactions on Electronic Devices, Vol. ED-19, No. 4, April 1972, pp.495–511. Dry toner compositions and methods of using same are disclosed in copending U.S. application Ser. No. 10/371,992, filed on even date herewith and entitled "DRY TONER COMPOSITION."

In liquid development, the toner particles are suspended in an insulative liquid, both constituents forming together the so-called liquid developer. During the development step, the toner particles are deposited image-wise on the latent electrostatic image-bearing carrier or magnetic image-bearing carrier by electrophoresis (under the influence of electrical fields) or magnetophoresis (under the influence of magnetic fields). In these particular development steps, the toner particles have, respectively, an electrical charge or a magnetization.

Recent progress in digital printing methods makes considerations such as cost per copy, layer thickness of the marking material, resolution, and speed of imaging extremely important. In this respect, liquid toning systems have marked advantages over dry toner imaging techniques because the imaging particles are much smaller in size (compared to dry toner particles) and are comparable in size to typical conventional ink layer thicknesses. Liquid toning processes are nowadays intensively studied for these reasons. However, one of the major impediments to liquid toning processes is the "wet" nature of such toning systems. As the toner particles are dispersed in a liquid dispersant and the developing process is conducted with such a "wet" developer, the challenge is how avoid any loss of this dispersant into the environment upon fixing, as in this fixing step the "wet" image is to be converted into a dry image. This is of concern since the dispersant is typically nonpolar in nature, and nonpolar solvents such as saturated hydrocarbons are typically used. Thus, concerns regarding organic vapor emissions makes it undesirable to design high speed imaging systems using such dispersants without also taking actions to avoid emission of such vapors into the environment.

The visible image of electrostatically or magnetically attracted toner particles is not permanent and has to be fixed. Fixing is accomplished by causing the toner particles to adhere to the final substrate by softening or fusing them, followed by cooling. Typically, fixing is conducted on substantially porous paper by causing or forcing the softened or fused toner mass to penetrate into the surface irregularities of the paper.

Dry development toners typically comprise a thermoplastic binder including a thermoplastic resin or mixture of resins (see, e.g., U.S. Pat. No. 4,271,249) and coloring matter, e.g., carbon black or finely dispersed pigments. Liquid-development toners are generally similar to dry development toners, except that the thermoplastic binding resin may be an integral part of the toner particles themselves and/or the binding resin may be present in the solution, with some part portion of it being partially adsorbed onto the toner particles.

There are different types of processes used for fusing a toner image to its final substrate. Some are based on fusing by heat, others are based on softening by solvent vapors, and others by the application of cold flow at high pressure under ambient temperature conditions. In the case of liquid development, the evaporation of the dispersant may also induce some fixing, especially in cases wherein the binding resin is partially present in said dispersant in a soluble state.

In fusing processes based on heat, two major types of processes are typically employed: "non-contact" fusing processes and "contact" fusing processes. In non-contact fusing processes there is no direct contact of the toner image with a solid heating body. Such processes include, for example: an oven heating process in which heat is applied to the toner image by hot air over a wide portion of the support sheet; and a radiant heating process in which heat is supplied by a light source, e.g., an infrared lamp or flash lamp, which emits infrared and/or visible light that is absorbed by the toner. In such "radiant" non-contact fusing processes, radiation (such as infrared radiation) may be at least partly absorbed by the final support and from this support transferred by conduction to the toner image(s) deposited thereon.

Non-contact fusing has the advantage that the non-fixed toner image does not undergo any mechanical distortion. The fine image details do not suffer distortion from transfer to a contacting fixing member, the so-called "offset" phenomena typically observed for hot pressure roller fusing. Non-contact fusing, however, has the major disadvantage that in the case of a process malfunction the final substrate or support can remain in the hot fusing zone for an undesirably long time, such that the substrate heats up to ignition temperature, thereby causing a fire hazard. This is especially a risk in the case of cut sheet-based engines. Special, costly measures have to be taken to avoid this major danger. Aside from this disadvantage, there is some difference between colors in fusing quality and image quality of the fused image, as the spectral absorption coefficients are not equal over all colors present in the print.

An alternative to "non-contact" fusing that is commonly employed is the so-called "contact" fusing process. In contact fusing, the support carrying the non-fixed toner image is conveyed through the nip formed by a heating roller (also referred to as a fuser roller) and another roller backing the support and functioning as a pressure-exerting roller (also referred to as a pressure roller). This roller may be heated to some extent so as to avoid strong loss of heat within the copying cycle. Other variations on the contact fusing process include use of a fuser belt combined with a pressure roller, or a combination of a fuser belt and a pressure belt.

SUMMARY OF THE INVENTION

A liquid toner composition wherein the particles comprising the toner are electrostatically or magnetically attractable and are suitable for use in the development of electrostatic charge images or magnetic patterns is desirable. Accordingly, such a composition is provided wherein the toner particles comprise a colorant and a binder resin, the binder resin comprising a crystalline phase-containing polymer or a mixture of crystalline phase-containing polymers, wherein the crystalline phase-containing polymer or mixture of crystalline phase-containing polymers has a melt energy larger than 35 J/g, and a solubility in the dispersant of the liquid developer at the melting temperature of the polymer that is lower than 2 g/l.

Also provided are methods for fixing unfixed toner images on a recording medium, including non-contact fusing methods, such as oven fusing, radiation fusing, and the like, as well as contact fusing methods, such as hot roller fusing, transfusing, and the like. Such liquid toner compositions are useful for the fusing or transfusing of toner images made with the above-described toner composition. The toner compositions, toner particles, and methods offer a variety of potential advantages over prior art methods. For example, the toner particles generally fix at low temperatures. The toner typically permits fixing at high process speeds, and is especially well suited for making color images that can be fixed at high process speed. The color images thus produced exhibit good mechanical stability, exhibit no or no significant rubbing sensitivity or smear of the final image; and do not have a tendency to show mutual tack upon storage at elevated ambient temperatures.

The toner of preferred embodiments is suited for making color images with good image quality and good color characteristics, and is prepared using simple binding resin materials and which can be produced using simple toner production processes.

In a first embodiment, a liquid developer composition is provided, the composition including a dispersant; and a toner including a colorant and a binder resin, the binder resin including a crystalline phase-containing polymer, wherein the crystalline phase-containing polymer has a melt energy greater than about 35 J/g, and wherein the crystalline phase-containing polymer has a solubility of less than about 2 g/l in the dispersant at a temperature 10° C. higher than a melting temperature of the polymer.

In an aspect of the first embodiment, the toner includes 5 wt. % or more of the crystalline phase-containing polymer.

In an aspect of the first embodiment, the dispersant has a resistance greater than $10^{10}$ Ohm·m.

In an aspect of the first embodiment, the toner further includes an amorphous polymer.

In an aspect of the first embodiment, a melting point of the crystalline phase-containing polymer is greater than or equal to about 65° C.

In an aspect of the first embodiment, a Tg of the amorphous polymer is greater than or equal to about 40° C.

In an aspect of the first embodiment, a melting point of the crystalline phase-containing polymer is lower than a softening point of the amorphous polymer.

In an aspect of the first embodiment, the crystalline phase-containing polymer includes a polyester.

In an aspect of the first embodiment, the binding resin of the toner has a melting temperature greater than or equal to about 50° C.

In aspects of the first embodiment, the amorphous polymer includes a polyester, or a mixture of a polyester and a non-polyester.

In aspects of the first embodiment, the colorant includes an inorganic pigment or an organic colorant.

In an aspect of the first embodiment, the toner further includes a colloidal inorganic filler.

In an aspect of the first embodiment, the liquid developer composition further includes a steric stabilizer. The steric stabilizer may include from about 5 wt. % to about 50 wt. % of the toner composition.

In an aspect of the first embodiment, the liquid developer composition further includes a charging agent. The charging agent may include oil soluble ionic surfactants, amphoteric surfactants, or ionic surfactants including organic acid metal salts.

In an aspect of the first embodiment, a particle size of the toner is from about 0.5 $\mu$m to about 5 $\mu$m.

In a second embodiment, a method for transfusing an image is provided, the method including transferring a liquid developer onto a heated intermediate member, the liquid developer forming an image, wherein the liquid developer includes a dispersant and a toner, the toner including a colorant and a binder resin, the binder resin including a crystalline phase-containing polymer, wherein the polymer has a melt energy greater than about 35 J/g, and wherein the crystalline phase-containing polymer has a solubility of less than about 2 g/l in the dispersant at a temperature 10° C. higher than a melting temperature of the polymer; transferring the image from the heated intermediate member to a final substrate in a nip; and applying mechanical pressure and heat to the final substrate, whereby the image is transfused to the final substrate.

In an aspect of the second embodiment, the image is a color image.

In an aspect of the second embodiment, the step of applying mechanical pressure and heat to the final substrate is conducted at a fusing speed greater than or equal to about 10 cm/sec.

In a third embodiment, a liquid developer composition is provided, the composition including a dispersant; and a toner comprising a colorant and a binder resin, the binder resin including a polymer composition, wherein the polymer composition has a crystallinity of greater than about 30 wt. %, wherein the polymer composition has a melt energy greater than about 10 J/g, preferably greater than 30 J/g or more preferably greater than 40 J/g and wherein the polymer composition has a solubility of less than about 2 g/l in the dispersant at a temperature 10° C. higher than a melting temperature of the polymer composition. It may be advantageous to limit the overall degree of crystallinity of the polymer composition, e.g. to less than 100 J/g, or less than 80 J/g.

DETAILED DESCRIPTION OF THE PREFERRED EMBODIMENT

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

Only limited teachings concerning liquid toning systems and methods are provided in the literature. A method involving non-contact fusing by dispersant evaporation and film forming by a solvated binding resin, as is employed in some specific liquid developer compositions, is a simpler method, but it has intrinsic disadvantages in terms of the sensitivity of the final fused image towards solvents in general. Also, compositions that exhibit good film forming properties generally also exhibit only limited mechanical stability of the final print to rubbing, mutual tack of prints at elevated temperature, and the like, due to the composition of the binding resin itself and its mechanical properties An alternative to this process is "thermal" fusing whereby the toner particle itself is thermoplastic. In a preferred embodiment, this thermal fixing can be done in a so-called "non-contact" way. After the drying step, the toner particle can melt and adhere to the substrate. The energy can be conveyed to the particle to be fixed by convection, absorption of radiation, and the like. In "Non-contact" fusing, however, the dispersant has to evaporate prior to or as a first step in the fusing process and the problem of emission has to be resolved at that stage. Energy has to be delivered to evaporate the dispersant. After this step, additional energy has to be supplied to fuse the image. This will also heat up the vapors and intensify the emission tendency.

Also, in the case of liquid toners, "contact" fusing can be employed. Some action has to be taken in order to avoid very "wet" toner images going into the hot nip of the contact fuser. Also, vapors are generated due to evaporation of the dispersant. These vapors may deteriorate the image itself as they can have a deteriorating effect on the fusing surfaces of the belt and/or rollers. The evaporation of the dispersant will give rise to emission directly from the nip position, but also indirectly by entrapment of vapor in the image and/or in the final substrate and by slow evaporation afterwards. It is thus beneficial to "dry" the "wet" image to some degree before conducting the real "contact"-fusing step. This drying can be done, for example, by heating before the fusing step, and/or by mechanically squeezing solvent out of the image. The temperature needed in order to fuse the image dictates the amount of dispersant that can still be in the "semi-wet" image entering the hot nip. Low fusing temperatures allow for images containing more dispersant to be fused.

A very special and preferred embodiment of contact fusing is the transfusing process. In this process, the image is transferred to an intermediate member which is heated, and the image is, after some residence time on this intermediate transfer member, transferred to the final substrate in a nip, whereby mechanical pressure is exerted as heat is applied. The image on the final substrate has good adherence and can be totally fixed, or the image can be fixed to an intermediate degree and post-treated in order to achieve the final fixing, especially the rendering of gloss and smoothness.

Whereas the different fusing methods discussed can be used in conjunction with liquid toners, the transfuse process is extremely interesting in regard to liquid toner systems, as the residence time on the intermediate allows conditioning of the "wet" image. The dispersant can be taken out of the "wet" image in a controlled way, whereby vapors can be easily evacuated. The toner image is also heated to a molten state, which makes it very similar in properties to a real ink layer. The second transfer from the heated intermediate to the final substrate is then similar to the transfer processes in offset, allowing the achievement of final images with almost perfect offset look-and-feel properties. The final transfer step yields no or no significant emission, either directly or indirectly, as the final substrate does not contact dispersant or dispersant vapors.

There are, however, complexities associated with this transfuse process. The first complexity is that the transfer of the image, especially the second transfer, is preferably almost 100%, which is markedly different from the transfer in typical offset processes, which typically have a 50% transfer rate. In the case of offset printing, this is not important as identical images are created. In the case of digital printing, however, this is not the case. Any image residue on the transfer medium has to be cleaned away, thus imposing the need for an almost 100% transfer in the transfuse step. This imposes strong boundary conditions to both the transfer medium and the toner formulation. Another feature is the temperature at which the transfuse process is conducted. It is beneficial that the temperature is not too high, in order to avoid too much heat propagating to the system, including the imaging system, the photoconductor, and other process elements. It is also preferred that the final substrate is not heated up to high temperatures in order to avoid property changes, such as curl, flatness, and waviness. On the other hand, the degree of transfuse and fixing should be good. There is thus a need for very specific toner compositions allowing melting and transfusing at very low temperatures. The third complexity arises from the fact that the transfuse member preferably has a high lifetime. Mechanical wear of the member can pose a problem, as well as the so-called "poisoning" of the member by toner, dispersant, or any other solvated ingredient. In the latter case, contaminants build up in the transfuse layer, reducing its adhesive and donating properties. This will reduce the transfer efficiency and create problems as discussed above. At the same time it permits exertion of stronger mechanical forces on the transfer medium, inducing greater mechanical wear. The degree of this mechanical wear will depend strongly upon the nature of the transfer member itself, whereas the contamination of the transfer member will not only depend on the nature of the transfer member but also on the nature of the toner used, the dispersant used, and additives used. Also, combined effects can occur. Operation at higher temperature will also be problematic due to the enhancement of poisoning effects, if present.

From the discussion on fixing of wet images, it is clear that there is a need to have very specific toner formulations allowing fusing at low temperature, especially when multilayered images are to be fused, as is the case in color imaging. This is even more preferred in the case of high-speed color imaging. In the case of the preferred fusing process, i.e., the transfuse process, there are even more reasons to employ low temperature fixing processes, as discussed above.

There are only limited teachings in the literature regarding low temperature fixing of wet images, apart from those based on pure evaporation and/or film forming methods, both methods having the disadvantage of rather unstable images, bad rub resistance, poor adherence to the substrate, and the like. Only limited teachings can be found regarding thermal fixing processes wherein the toner particles soften at some temperature and adhere to the substrate. The nature of the toner particle itself, more specifically of the resin constituting the toner particle, will largely affect its thermal fixing capability. Depending upon the very specific type of resin used, specific viscoelastic properties can be observed.

The so-called softening temperature of the toner resin typically determines the minimal temperature for fixing. A softening point as low as possible is generally preferred. However, there is a practical limit to this approach, since a too low softening point generally correlates with a low Tg value. Toner images made up of resins having a low Tg have a marked tendency to be tacky, especially when imaged areas are contacting each other, e.g., in pages of a book. It is clear that this drawback will become of even greater concern in the case wherein the ambient temperature is higher. As a consequence, some tradeoff has to be made between fixing attitude and non-tackiness of the final images.

An interesting alternative has been proposed in U.S. Pat. No. 5,276,492 to Indigo. This approach offers the possibility of fusing at low temperatures by using a structured resinous matrix, which exhibits no or no significant tack in the final image. The process is suited for transfusing. The intrinsic concept is that the resinous matrix is "plasticized" by the solvent to a high degree, so that the fixing temperature drops drastically. A very specific toner composition is described, mainly based on polyolefin resins, also containing a substantial amount of more polar moieties, such as, e.g., vinylacetate or (meth)acrylic acid. It is understood from the teachings that the polar moieties play a role in achieving sufficiently strong bonding to paper, as paper is semi-polar in nature. The polar moieties also make the resin high in softening temperature and exhibit low tack at ambient temperature. On the other hand, the polyolefinic nature of the resin is exploited in order to create compatibility with the dispersant, a saturated hydrocarbon solvent such as, e.g., Isopar G or Isopar L, as described in U.S. Pat. No. 5,276,492, which describes a polyolefinic moiety comprising ethylene.

The softening behavior of such resins is described in more detail in U.S. Pat. No. 5,276,492. The resin is made to dissolve in the hydrocarbon medium at a temperature of about 90–130° C., depending upon the exact chemical composition of the resin, especially upon the chemical nature of the co-monomer to ethylene. The resultant mixture behaves as a single phase. Upon cooling, a solvent-swollen resin precipitates. This occurs at a rather sharp temperature of around 90° C. The solvent-swollen resin is elastic and adheres well to paper. This particular behavior is very advantageous to the transfuse process, since the molten resin/solvent mixture on the transfuse member is cooled below this film forming temperature upon contact with the paper. The resinous matrix becomes elastic and the stripping of the ink film from the transfuse member towards the paper is strongly favored by this stiffening process.

Whereas this process is preferred for transfuse methods, it also has disadvantages. Firstly, there is still solvent in the ink on the paper, which evaporates slowly and hence leaches into the environment. Secondly, the presence of the solvent in the ink makes very strong bonding of the ink to the paper difficult, as the apolar or nonpolar nature of the solvent impedes good interaction of the resin with the paper. Thirdly, since the resin it completely dissolved on the transfuse member there is intimate contact of the constituting molecules with the transfuse member. This poses a possible danger for poisoning of the transfer member by interpenetration of molecules into the surface of the transfuse member. This process may alter the adhesive nature of the transfuse member and this may result in turn in lower transfer efficiencies. These effects compromise to some degree the desirable low fusing behavior of liquid toners based on such specific resins.

It appears that no general solution is found in the literature to the issues related to fusing of liquid toners, more specifically to transfusing of liquid toners, and that there is still room for improvement, especially in the use of such processes in high speed color imaging.

Surprisingly, it has been found that it is possible to design a liquid toner composition using simple resin materials that shows appreciable latitude with respect to low viscosity melt behavior, the toner composition allowing the creation of high quality color prints in terms of image gloss, fixing degree, and mechanical stability of the fused image. It has moreover been found that this particular toner composition is very well suited for fixing color images at a high fusing speed, e.g., 10 cm/sec and higher. It has moreover been found that this particular toner composition exhibits no or no significant interprint tack even after storage in a pile and at ambient conditions of elevated temperature. It has been found that by using this toner composition, it is possible to design a fixing process allowing fusing at the above mentioned speed and allowing the realization of high quality color images. It has been found that by using this toner composition, it is possible to design a transfixing process allowing transfixing at the above-mentioned speed, and allowing the realization of high quality color images. It has been found that by using this toner composition in combination with a transfix process it is possible to design a fixing method allowing for minimal vapor emission. The different aspects of the preferred embodiments will be described in more detail hereinafter.

The specific liquid toner composition is characterized by the toner particle containing crystalline phase-containing polymer, and that the toner particle is substantially insoluble in the dispersant at elevated temperature, such as the softening or melting temperature of the toner, the temperature being characteristic of the fixing temperature of the toner. Whereas in the preferred embodiments described herein, the toner particle itself is intrinsically composed out of a crystalline phase-containing resin, it was found that a similar performance can be found when such a resin is combined with an amorphous resin. It was found that the specific monomer composition and the molecular weight of the resins are not as relevant in achieving the desired fixing properties. It has been found that it is preferred that the crystalline resin has a good tendency towards crystallinity so that the toner particle shows crystalline behavior, and at the same time that the toner particle is not substantially soluble in the dispersant.

The fact that substantially no solubility of the toner particle in the dispersant is observed yields the major advantage that an increased latitude can be realized regarding contact fusing methods, since otherwise the solvated species will penetrate in the fixing surfaces of rollers, belts, and the like, and alter the adhesive properties. This property, however excludes the exploitation of any plasticizing effect in order to decrease the fixing temperature lower than the typical softening temperature of the resins used. It has, however, been found that by using toner particles comprising crystalline phase-containing resins, a substantial lowering in fixing temperature can be realized. It is also found that a fixing temperature lower than the melting temperature of the crystallites can be achieved, in toner containing only the crystalline phase containing polymer, as well as in toners containing a blend of both amorphous and crystalline material. It is believed that this desirable behavior is the consequence of a kind of softening action by a pre-melt process of disturbed crystallites, inducing a lowering in viscosity even prior to the macroscopic melt-temperature. It has been found that a reduction in temperature of up to 20° C. is possible, depending on the nature of the toner particle.

The melting behavior of such materials is very advantageous in fusing at low temperature. The low melt viscosity will also make the adhesion of the toner to the paper in the transfuse nip efficient.

The fact that the toner particle contains crystallizable material is believed to play a role in the process of stripping the toner layer very efficiently away from the transfuse member. As the toner layer contacts the paper, the temperature drops and crystallization starts. This will lead to stiffening of the toner, and the toner film can easily be peeled away from the transfuse member.

The properties of the crystalline phase containing polymer are expressed by its melting point, as well as by its crystalline behavior. Preferably the melting point is selected to be at a low temperature, as fusing at high speed and low fixing temperature is preferred. In this respect, a melting point lower than 175° C., a typical fixing temperature of hot roller fusing systems, is an obvious upper limit. More preferably, the melting point is lower than 130° C., and preferably even lower than 110° C. On the other hand the melting temperature should be high enough so that at even at more elevated temperatures during storage, no or no significant fundamental changes in constitution of the toner material can occur. This means a melting temperature higher than 50° C., more preferably higher than 65° C. is generally preferred. A particularly preferred region for melting temperature will lie between 65° and 110° C.

Whereas in the case of dry toner particles made up of crystalline phase-containing resins, problems are encountered due to a marked cohesivity of the toner particles or adherence of the toner particles to carrier particles in the case of two-component developers, or the adhesion of the toner particles to other surfaces, such as the photoconductor, the colloidal nature of the wet toner substantially reduces these problems. This makes it possible to use crystalline resins even with very low melting temperatures down to 85° C. It has been found that the specific degree of crystallinity and crystallization energy play a role in the performance of the toner compositions of preferred embodiments.

As in the toner compositions according to the preferred embodiments, amorphous polymer can be a part of the composition, and high crystallization tendency is preferred, suggesting high crystalline content in the crystalline phase-containing polymer. Apart from the degree of crystallinity, the tendency to crystallize also plays a role. The lower the intrinsic crystallization energy, the lower the tendency to build up the crystalline phase, and the slower the crystallization process occurs. A slow process may induce problems, as the fused images may have a "tack" persisting for some time after the fusing process. A value that reflects both the amount of crystallinity as well as the crystallization energy is the melt-energy of the crystalline polymer or mixture of the crystalline polymers.

Apart from these considerations, it is found that linear to only moderately branched crystalline polymers are especially effective. While not wishing to be bound by any particular theory, the reason probably lies in the fact that branching and/or cross-linking impedes efficient ordering in the system, and hence will lead to loss in crystallinity. In the case where a blend of amorphous and crystallite-containing resins is used, it is advantageous that there is some compatibility between the crystalline and amorphous material in order to prevent identity problems in regard to the toner particles, since in the case of liquid toners, the size is substantially smaller and typically in the micron range. In the case of a blend of amorphous and crystalline resin being used, it is advantageous to employ an amorphous resin with a Tg higher than 40° C., but at the same time a softening point that is not too high. A too high softening point will increase fixing temperature. On the other hand, a low Tg will increase tack.

The polymers described above as "crystalline" include those which possess some degree of amorphousness, but which retain overall their substantially crystalline character. It is generally preferred that the crystallinity of the polymer is greater than about 30 wt. %, more preferably greater than about 50 wt. %.

The polymers described above as "amorphous" include those which possess some degree of crystallinity, but which retain an overall substantially amorphous character. It is generally preferred that the crystallinity of the amorphous polymer is less than about 25 wt. %, more preferably less than about 15 wt. %.

In certain embodiments, suitable binder resins may be prepared by blending or mixing two or more polymers with suitable "amorphous" and/or "crystalline" character. Alternatively, suitable binder resins of certain embodiments may include, e.g., a single polymeric material exhibiting both an "amorphous" phase and a "crystalline" phase.

From experimental work it was found that the crystalline polymer or polymer mixture preferably has a melt energy of at least 35 J/g, as measured by DSC-method, as described below. A value lower than 35 J/g reflects a tendency for crystallization that is too low. The crystalline material should be linear or at most moderately branched. Whereas there is no specific region regarding a preferred molecular weight of the crystalline polymer, it is found that there is a benefit to using lower molecular weight materials, for two reasons: (1) high molecular weight material will give higher viscosity and hence slower crystallization behavior and reduction in crystallinity; and (2) low molecular weight material will show a larger entropy term upon mixing with the amorphous material and hence more easily induce a latitude towards compatibility of the resins in case a blend is used. It is clear that the second condition refers to the situation wherein a blend is used.

In the case wherein a blend of crystalline and amorphous material is used, it is preferred that there is, in the molten state, a good compatibility as the low viscosity of the molten material will in such a case be able to induce further viscosity drop in the total resinous matrix of the toner particle. It is also preferred that, upon cooling, a fair degree of compatibility persists, so that the only separated domains are the crystallites that form. This will lead to a very intimate mixture of the resins, resulting in a good uniformity of the toner particles made up from this blend. Also, the intimate mixture will induce a very efficient melt viscosity drop upon melting of the crystallites present. From these considerations, it is expected that it is beneficial that the melting point of the crystallites is lower than the typical softening temperature of the amorphous phase. It is preferred that the melting point should at most be 10° C. higher than the softening temperature of the amorphous phase. It is considered preferable that the melting point is lower than the softening point of the amorphous phase, even more preferably 10° C. to 20° C. lower than this softening temperature. It is possible to conduct a very simple test to select this desired compatibility, as will described below.

Crystallite-containing polymer resin compositions suited for the preferred embodiments can have a variety of compositions, as the composition itself is not believed to be of particular relevance. Pure aliphatic polymers as well as aromatic group-containing polymers can be employed. Regarding polyester-based materials, reference is made to European Patent No. 0146980, describing inter alia, aliphatic crystallite-containing resins comprising long chain diols and/or long chain diacids. According to the previous discussion, it is, however, preferred that the melting temperature is higher than 50° C., preferable higher than 65° C. and lower than 110° C. An interesting discussion regarding crystalline polyesters is provided in "Textbook of Polymer Science" by Billmeyer, Wiley Interscience, 1971, p 220, showing inter alia the change in melting point of materials including linear polyesters containing a long chain di-alcohol (decamethyleneglycol) in combination with aliphatic saturated diacids ranging from short (1 carbon atom-containing) to long (10 carbon atom-containing) interacid methylene groups. Likewise, combinations of a short di-alcohol, e.g. glycol, with long chain diacids can be employed, as shown in the same reference. Use of an interacid group chain of at least 8, preferably at least 10 carbon atoms is preferred in order to have melting temperatures higher than 65° C.

Combined long chain systems such as poly (decamethylene dodecanoate) can be employed as well. Additional data on crystalline polymers can be found in "Properties of Polymers" by Van Krevelen, Elsevier Publishing Company, 1972, appendix 2.

Apart from pure linear crystalline polyesters, other materials can be considered. A desirable crystallite-containing polymer is polycaprolactone. Also, aromatic moiety-containing polymers can be used, as described in U.S. Pat. No. 5,057,392, describing inter alia polymers containing hexane-diol and butane-diol as diol components, and terephthalic acid and isophthalic acid as diacids. Typical melting points (MP) range from 90–100° C. Table 1 describes some polyester-based crystalline materials also investigated, however these examples are non-limiting and it is understood that the preferred embodiments may employ other materials. The melt energy (M-E) is also given in the table in J/g. CP refers to a crystalline polymer sample.

TABLE 1

| Sample | MP (° C.) | M-E (J/g) | type |
|---|---|---|---|
| CP1 | 85 | 100 | Linear |
| CP2 | 103 | 42 | Linear |
| CP3 | 115 | 44 | Non-linear/slight branching |

Amorphous polymer resin compositions suited for the preferred embodiments can have a variety of compositions, as the composition itself is not believed to significantly impact the performance of the polymer in the preferred embodiments. Preferred polymers are found in the family of polyesters, as well as in the family of the so-called hybrid resins, such resins being a type of resin comprising polyester as well as non-polyester, e.g., styrene/acrylic or styrene/methacrylic constituents. A polyester resin suitable for use in toner particles according to the preferred embodiments can be selected from, e.g., the group of polycondensation products of (i) di-functional organic acids, e.g., maleic acid, fumaric acid, succinic acid, adipic acid, terephthalic acid, isophthalic acid; and (ii) di-functional alcohols (diols) such as ethylene glycol, triethylene glycol, aromatic dihydroxy compounds, preferably a bisphenol such as 2,2-bis (4-hydroxyphenyl)-propane, also referred to as bisphenol A, and alkoxylated bisphenols, e.g., propoxylated bisphenol A, examples of which are given in U.S. Pat. No. 4,331,755. For the preparation of such resins, reference is made to GB-1373220. A non-linear gel-containing resin suitable for use in toner particles according to the preferred embodiments can be selected from, e.g., the group of resins obtained from similar compositions as mentioned for the linear polyester resins discussed above, but containing additionally at least 1% (expressed in molar ratio) of a tri- or higher valent monomer. In the case of an acidic crosslinker being used, it can be selected from, e.g., the group of aromatic poly-acids with a valence higher than 2, such as, e.g., trimellitic acid. In the case of an alcohol-based cross linker being used, it can be selected from, e.g., 2-ethyl-2-hydroymethyl-1,3-propanediol, tetrakishydroxymethylmethane, and glycerol.

As an example of a useful resin, data is listed in Table 2 providing melt viscosity and elasticity at 120° C., as well as composition and type of polyester. Compositions can be read as follows: PBA is propoxylated bisphenol A; TA is terephthalic acid; and AA is adipic acid.

TABLE 2

| type | Visc. 120° C. Pa · s | 1/tg @ 120° C. | Tg (° C.) | Softening temperature (° C.) | alcohols | acids | |
|---|---|---|---|---|---|---|---|
| AP1 | 80 | 0.03 | 54 | 101 | PBA (100) | TA/AA (75/25) | Polyester type |
| AP2 | 100 | 0.3 | 41 | 94 | | | Hybrid type 67% polyester 33% styrene acrylic |

Test for Determination of Softening Point

The softening temperature is measured with a CFT500 apparatus sold by Shimadzu. A sample of 1.1 g of the material is put in the preheated apparatus at 80° C. equipped with a die with a bore of 1 mm in diameter and 10 mm in length. The sample is thermally equilibrated for 7 minutes. Then, the temperature is raised at a rate of 3° C./min and the material is subjected to a load of 10 kg. The outflow of the material is monitored.

The softening temperature is determined as the temperature wherein half of the sample has flowed out of the apparatus.

Test for the Determination of Tg

Tg is determined according to ASTM D3418-82.

Test for the Determination of Viscosity of Resin

For determining the melt viscosity of the selected sample, a Carrimed CSL500 is used. The viscosity measurement is carried out at a sample temperature of 120° C. A sample having a weight of 0.75 g is applied in the measuring gap (about 1.5 mm) between two parallel plates of 20 mm diameter, one of which is oscillating about its vertical axis at 100 rad/sec and an amplitude of $5\times10^{-3}$ radians. Before recording the measurements, the sample is allowed to attain thermal equilibrium for 10 minutes. The viscosity is expressed in Pa·s and the elasticity (1/tg) is determined as the ratio of G'/G".

Test for the Determination of Crystallization Energy and Melting Point

Melting properties are measured by DSC type equipment, e.g., a Seiko DSC220C. Approximately 10 mg of material to be investigated is put into the measuring cup and an empty pan is used as a reference. Heating rate and cooling rate (liquid nitrogen) is set at 20° C./min. The sample is measured in a first run after cooling the sample to −50° C. and then heating to 150° C. The melting temperature is taken at the maximum of the endothermic peak corresponding to the melting process. The melting energy (crystallization energy) is read from the chart as the area between the curve and the baseline corresponding to the position on the melting curve. This melting energy/crystallization-energy is expressed in J/g.

Test for Determination of Compatibility

A simple miscibility test can be used to determine compatibility. The materials (1/1 ratio by weight) are mixed and melted mechanically at a temperature of 150° C. The equilibration time is 15 minutes. The mixture is observed in terms of milkiness and/or phase separation at this temperature. Pronounced milkiness and/or phase separation is indicative of insufficient compatibility. Results are reported in Table 3 for the compatibility of various polymer combinations.

TABLE 3

| | | |
|---|---|---|
| AP1 | CP1 | Transparent |
| AP1 | CP2 | Transparent |
| AP1 | CP3 | Very milky/hazy |
| AP2 | CP1 | Transparent |

Test for Solubility 50 g of the material to be tested and 950 g of Isopar L were put in a vessel. The temperature was raised to 10° C. higher than the corresponding melting point of the material. The dispersion was mechanically stirred. After stirring, the dispersion was allowed to settle. A sample of the supernatant liquid was taken and the concentration of the dissolved material was determined gravimetrically after evaporation of the dispersant. The solubility was expressed in % w/w and is given in Table 4.

TABLE 4

| | Solubility ( % w/w) |
|---|---|
| CP1 | <0.1 |
| CP2 | <0.1 |
| CP3 | <0.1 |
| Nucrell 599 | 4.93 |

Determination of Fixing Properties

Contact-fusing by Hot Roller Fixing Process

A symmetrical fixing unit is used containing two identical fuser rollers, an upper roller and lower roller. The outer diameter of the rollers is 73 mm. Both rollers are silicone rubber-based, have a hardness of 50 ShoreA, and have a thickness of the rubber coating of 3 mm. Thermal conductivity is set at 0.4 W/mK. Electrical conductivity is set at medium level in order to avoid paper jams due to electrification. A nip of 9–10 mm is formed. Both rollers are oiled at a rate corresponding to a low oil deposition on the fixed print. The oil deposition is defined as the amount of oil deposited on a single side of an A4-sized paper in the fixing process in a multiple print mode and is expressed in mg/A4. The oil deposition is approximately 10–15 mg/A4. The temperature of the fixing device is typically is set in the range of 80–180° C. A single-sided coated 100 g/m$^2$ paper is used. The toner deposition was set at 0.5 mg/cm$^2$ toner particles, corresponding to quadruple toner layers. Before fixing the liquid toner layer, measures are taken to adjust the solids content to at least 50% w/w by removing the appropriate amount of dispersant.

Contact Fusing by Transfuse Process

The transfuse fixing unit used comprises a donor roller with a diameter of 14 cm for applying a liquid toner layer, a heated transfuse roller with a diameter of 7 cm and a paper path allowing paper to contact the transfuse roller in a position located 180 degrees away from the position corresponding to the donor roller/transfuse roller contact.

A liquid toner layer is applied on the donor roller and conditioned, if necessary, to adjust the solid content to an applied mass of 0.5 mg/cm$^2$, i.e., equivalent to 4 toner layers. The liquid toner layer is then transferred to the transfuse roller by an electrical field. Upon contact of the liquid toner layer with the heated transfuse roller, some dispersant is evaporated and the toner is heated. The toner layer is adhesively transferred, in a transfuse nip of 8 to 10 mm, to the paper. The transfuse temperature is determined as the temperature of the transfuse roller just before the toner enters the transfuse nip.

The transfuse roller has a PDMS top layer and a hardness of 40 to 60 ShA. The electrical conductivity is set at a medium level in order to achieve an efficient electrical transfer between the donor roller and the transfuse roller.

A single sided coated 100 g/m$^2$ paper is used in the experiments.

Tape Test

Immediately after the fusing of the toner image at the selected fusing temperature the image on the paper is taped to check the bonding to said paper. The amount of toner that adheres to the tape is visually inspected. Scotch Magic tape type 810 is used in order to check the adherence properties of the fused toner.

Tack Test

The tack test is performed by putting a weight of 50 g/cm$^2$ for 15 min at a temperature of 60° C. on a folded fused toner image (image inside). The toner image is made with a coverage of 0.5 mg/cm$^2$. After 15 min, the sample is cooled down and unfolded observing the amount of tack between the imaged surfaces. Evaluation was done on samples with an F-test ranking of 1 or 2.

Toner Production

For producing visible images, the toner should contain, in the resinous binder, a colorant which may be black or a color of the visible spectrum, not excluding, however, the presence of mixtures of colorants to produce black or a particular color.

For producing wet toner according to the preferred embodiments, different methods are available. A first preferred method is based on a multiple step approach. First a blend of the resin(s) and coloring substance(s) is made. Then, this material is milled down, e.g., by dry milling procedures to the $\mu$m range. A final step is then used wherein the powder is either converted directly into a colloid and/or is converted into a dispersion which is further milled down to the appropriate size. The colloid is made using a dispersant showing high insulating properties, as expressed by a bulk conductivity being at least $10^{10}$ Ohm·m or more.

The typical concentration of the core material of the toner in the wet developer lies in the range of 1 to 20% w/w, depending on the specific application methods used in the development process and in the subsequent imaging process steps.

In order to stabilize the colloid, specific additives can be used. For example, in "Photographic Science and Engineering," Vol. 28, No. 3, May/June, page 119 (1984), there is described the use of a soluble random copolymer based on methacrylic moieties in order to stabilize the toner. It is believed that some parts of the stabilizing molecule adhere to the toner particle, whereas other parts of the stabilizer protrude into the dispersant, giving as an overall effect a degree of steric stabilization. Also, specific block copolymers can be used in order to give a similar steric stabilization, as described in EP-128244. Apart from the steric stabilization, a substantial part of colloid stabilization is by charge. Specific charge control agents have been discussed in the literature. The charge also contributes to the electrical response of the toner particle, and hence the developing and imaging capability of the toner particle. Apart from this imaging capability, the charge will also give some contribution to the colloidal stabilization by an electrostatic repulsion interaction between the different toner particles. Addition of such charging additives will thus be preferred in order to realize wet toner systems.

Apart from the described preparation method, other methods can also be used. A preferred method is applicable to the preparation of the wet toners according to the preferred embodiments, and is based on the fact that the toner core material is substantially insoluble in the dispersant even at temperatures corresponding to the softening temperature of the resins used. In this particular case, it is possible to prepare the wet toner and/or developer by making a slurry of the resin/colorant mixture in the dispersant, together with stabilizers. The temperature is then raised while stirring vigorously. At the temperature corresponding to the softening temperature of the toner core, the stirring is set at conditions corresponding to a high shear force, thus breaking up the molten toner particles to smaller sizes. The process can be controlled by shear force, stabilizers, and/or temperature. Once the desired particle size is obtained, as can be verified, e.g., by microscope, the dispersion is cooled and the particle size is fixed. It is clear that this method is highly preferred and is a direct consequence of the very specific nature of the toner composition.

In the preparation of colored toner particles a resin or a resin blend as defined herein is mixed with said coloring matter which may be dispersed in said blend or dissolved therein, forming a solid solution.

In black-and-white copying, the colorant is usually an inorganic pigment which is preferably carbon black, but may also be, e.g., black iron (III) oxide. Inorganic colored pigments include, e.g., copper (II) oxide, chromium (III) oxide powder, milori blue, ultramarine cobalt blue, and barium permanganate.

Examples of carbon black include lamp black, channel black and furnace black, e.g., SPEZIALSCHWARZ IV (trade name of Degussa Frankfurt/M-Germany) and VULCAN XC 72 and CABOT REGAL 400 (trade names of Cabot Corp. High Street 125, Boston, U.S.A.).

In order to obtain toner particles having magnetic properties, a magnetic or magnetizable material in finely divided state is added during the toner production.

Materials suitable for said use include, e.g., magnetizable metals such as iron, cobalt, nickel and various magnetizable oxides, e.g., hematite ($Fe_2O_3$), magnetite ($Fe_3O_4$), $CrO_2$ and magnetic ferrites, e.g., those derived from zinc, cadmium, barium, and manganese. Various magnetic alloys may also be used, e.g., permalloys and alloys of cobalt-phosphors, cobalt-nickel and the like, or mixtures of these.

Toners for the production of color images may contain organic colorants that may include dyes soluble in the binder resin or pigments including mixtures thereof. Particularly useful organic colorants are selected from the group consisting of phthalocyanine dyes, quinacridone dyes, triaryl methane dyes, sulfur dyes, acridine dyes, azo dyes and fluoresceine dyes. A review of these dyes can be found in "Organic Chemistry" by Paul Karrer, Elsevier Publishing Company, Inc. New York, U.S.A. (1950).

The dyestuffs described in the following published European patent applications may also be used: EP-0384040, EP-0393252, EP-0400706, EP-0384990, and EP-0394563.

In order to obtain wet toner particles with sufficient optical density in the spectral absorption region of the colorant, the colorant is preferably present therein in an amount of at least 3 to 5% by weight with respect to the total toner composition, more preferably in an amount of 5 to 20% by weight. The amount is selected in such a way as to obtain the specified optical density in the final image.

Other fillers can be added to the toner composition to fine tune melt properties and/or cohesivity at ambient temperature and/or mutual tack of images. For example, colloidal inorganic fillers such as colloidal silica, alumina, and/or titanium dioxide can be used in minor amounts. Care should be taken, as inorganic fillers may give rise to an undesired high melt viscosity, the need for higher fusing energies, and may inhibit a bright color.

The toner powder particles according to the preferred embodiments can be prepared by mixing the above defined binder(s) and ingredients in the melt phase, e.g., using a kneader. The kneaded mass preferably has a temperature in the range of 90 to 140° C. It is, however, preferred that said homogenization process is done at a temperature higher than the softening temperature and/or the melting temperature of the crystalline material (and amorphous material, in case it is co-blended), since materials are preferably molten up to a sufficient degree in order to realize an intimate mixture. After cooling, the solidified mass is crushed, e.g., in a hammer mill and the coarse particles obtained can be further broken, e.g., by a jet mill to obtain sufficiently small particles and afterwards the desired fraction can be separated by classification techniques known in the art, so that an average volume particle size of about 2 to 10 um is obtained, when measured with a Coulter Counter™ Model Multisizer, operating according to the principles of electrolyte displacement in narrow aperture and marketed by Coulter Electronics Corp., Northwell Drive, Luton, Bedfordshire, LC 33, UK.

Suitable milling and air classification may be achieved when employing a combination apparatus such as the Alpine Fliessbeth-Gegenstrahlmühle (A.F.G.) type 100 as a milling apparatus and the Alpine Turboplex Windsichter (A.T.P.) type 50 G.C. as an air classification apparatus, available from Alpine Process Technology, Ltd., Rivington Road, Whitehouse, Industrial Estate, Runcom, Cheshire, UK. Another useful apparatus for said purpose is the Alpine Multiplex Zick-Zack Sichter, also available from the last mentioned company.

In most cases, the thus obtained toner particles are too large to be easily used in wet toner imaging. The larger particles have a marked tendency to settle by gravity after being dispersed in an insulating dispersant. It is preferred to reduce further the particle size down to 1–2 μm. This can be done by different techniques, a preferred method being colloid milling. Use can be made of a typical colloid mill, such as a sand or bead mill. A sand or bead mill comprises a housing, a rotary element, and a milling medium, e.g., silica-based pearls and/or beads. The mill is charged with the dispersion to be milled down at a typically solid mass concentration of 10 to 40%. Useful laboratory mills are the Minizeta and Labstar mills from Netzsch Feinmahltechnik Gmbh. By adjusting the process parameters of the mill, such as milling time, speed, solids content, the particle size can be set to any desired size, preferably a size in the range of 0.5 μm to 3.5, 4, 4.5, 5, 5.5, 6, 7, 8, 9, or 10 μm or more, and more preferably in the range from 1 or 1.5 μm to 2, 2.5, or 3 μm. The particle size can be measured using a disc centrifuge, e.g., model DC18000 from CPS Instruments Ltd. To the dispersion to be milled down can additionally be added a steric stabilizer, and optionally a charge directing agent. The steric stabilizer can be added at a concentration of 5 to 30% w/w. The charging agent can be added either during the preparation of the colloid or after the milling process. After the milling operation, the colloid is separated from the milling medium by filtration or other means and can be set at the appropriate concentration for further use. Optionally, additional steric and/or charge stabilizers and/or directors can be added.

A detailed discussion of charge directors can be found in U.S. Pat. No. 5,998,075. The charge director is substantially solvated or dissolved in the carrier liquid, and is added for the purpose of affecting the quantity of charge of the toner particles. Preferable charge directors include oil soluble ionic surfactants such as basic petroleum sulfonic acid salts commercially available from Witco Chemical or Matsumura Oil Research Corporation, amphoteric surfactants such as lecithin, and ionic surfactants composed of organic acid metal salts commercially available from Condea Servo BV.

The toner particles are dispersed in an insulating dispersant. Preferred dispersants are described in U.S. Pat. No. 5,998,075. The carrier liquid has a resistance in a range of about $10^{10}$ Ohm·m to $10^{15}$ Ohm·m, which does not disturb the electrostatic latent image. Preferably the liquid has a boiling point which allows easy drying or evaporation. Furthermore, it is preferable that the solvent emits no foul odor, is not poisonous, and has a relatively safe flammability point. Care has to be taken as well regarding the solvating properties of the dispersant, and upon specific selection of the dispersant, as some unwanted solubility of the toner particles may arise. Aliphatic hydrocarbon may be used as a carrier liquid, or alicyclic hydrocarbon, polysiloxane, or other carrier liquids, as well as mixtures of them. Amongst these, normal paraffin solvents and isoparaffin solvents are preferable in view of odor, harmlessness, and cost. Examples of the solvents include Isopar C, E, G, H, L, M, K and V (each available from Exxon-Mobil), Shellsol (available from Shell Oil), and others.

The wet developer can then be used to create an image which will be transferred and fixed to the final substrate as explained in more detail in the different examples. The preferred embodiments are illustrated by but not limited to the following examples. All ratios, percentages, and parts mentioned are expressed by weight unless stated otherwise.

EXAMPLES

Example 1

A mixture of 42.5% of resin CP1, 42.5% of resin AP1 and, 15% of a Cu-phthalocyanine blue pigment (CI 15:3) was melt-blended in a laboratory kneader for 30 minutes at 110° C. After cooling, this mixture was first roughly crushed and afterwards milled down by a jet mill (type 100AFG from Alpine) to a particle size of 8.9 μm. This product was named TC1 (Toner Composition 1). A mixture of 18 g TC1, 45 g of a 10% solution in Isopar L of a isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.), and 62 g Isopar L was made.

Wet grinding was effected on this mixture with a sand mill, by processing for 2 hours in a 0.45 liter vessel equipped with a water jacket, with a cooling medium at 20° C. The disc rotation was set at 1000 RPM and 400 g of 20–30 mesh sand (Ottawa sand) was used as grinding medium. The concentrated liquid dispersion is separated from the sand by filtration. A liquid developer having a volume average particle diameter of 1.4 μm measured by disc centrifuge model DC18000 of CPS Instruments Ltd. was prepared.

A liquid developer No. 1 was obtained by diluting the above concentrated liquid developer to 4% solids (w/w) with Isopar L.

Example 2

A mixture of 20% resin CP1, 65% of resin AP1, and 15% of a Cu-phthalocyanine blue pigment (CI 15:3) was melt blended in a laboratory kneader for 30 minutes at 110° C. After cooling, this mixture was first roughly crushed and afterwards milled down by a jet mill (type 100AFG from Alpine) to a particle size of 8.2 μm. This product was named TC2. A mixture of 18 g TC2, 111 g Isopar L, and 2 g barinate B (a basic barium sulfonate of the Witco Company) was made. Wet grinding was effected in the same way as in Example 1. In this manner, a liquid developer having a volume average particle diameter of 1.48 μm, measured by disc centrifuge model DC18000 of CPS Instruments Ltd., was prepared.

A liquid developer No. 2 was obtained by diluting the above concentrated liquid developer to 4% solids (w/w) with Isopar L.

Example 3

A mixture of 10% of resin CP1, 75% of resin AP1, and 15% of a Cu-phthalocyanine blue pigment (CI 15:3) was melt-blended in a laboratory kneader for 30 minutes at 115° C. After cooling, this mixture was first roughly crushed and afterwards milled down by a jet mill (type 100AFG from Alpine) to a particle size of 8.2 μm. This product was named TC3. A mixture of 18 g TC3, 45 g of a 10% solution in Isopar L of a isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.), and 62 g Isopar L was made. Wet grinding was effected in the same way as in Example 1. In this manner a liquid developer having a volume average particle diameter of 1.46 μm, measured by disc centrifuge model DC18000 of CPS Instruments Ltd., was prepared.

A liquid developer No. 3 was obtained by diluting the above concentrated liquid developer to 4% solids (w/w) with Isopar L.

Example 4

A mixture of 5% of resin CP1, 80% of resin AP1, and 15% of a Cu-phthalocyanine blue pigment (CI 15:3) was melt-blended in a laboratory kneader for 30 minutes at 115° C.

After cooling, this mixture was first roughly crushed and afterwards milled down by a jet mill (type 100AFG from Alpine) to a particle size of 9.2 μm. This product was named TC4. A mixture of 18 g TC4, 45 g of a 10% solution in Isopar L of a isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.), and 62 g Isopar L was made.

Wet grinding was effected in the same way as in Example 1. In this manner, a liquid developer having a volume average particle diameter of 1.54 μm, measured by disc centrifuge model DC18000 of CPS Instruments Ltd., was prepared.

A liquid developer No. 4 was obtained by diluting the above concentrated liquid developer to 4% solids (w/w) with Isopar L.

Example 5

A mixture of 42.5% of resin CP2, 42.5% of resin AP1, and 15% of a Cu-phthalocyanine blue pigment (CI 15:3) was melt blended in a laboratory kneader for 30 minutes at 115° C. After cooling, this mixture was first roughly crushed and afterwards milled down by a jet mill (type 100AFG from Alpine) to a particle size of 9.5 μm. This product was named TC5. A mixture of 18 g TC5, 65 g of a 7% solution in Isopar L of a polystyrene (25)/butadiene(75) block polymeric stabilizer and 47 g of Isopar L was made. Wet grinding was effected in the same way as in Example 1. In this manner, a liquid developer having a volume average particle diameter of 1.37 μm, measured by disc centrifuge model DC 18000 of CPS Instruments Ltd., was prepared.

A liquid developer No. 5 was obtained by diluting the above concentrated liquid developer to 4% solids (w/w) with Isopar L.

Example 6

A mixture of 85% of resin CP2 and 15% of a Cu-phthalocyanine blue pigment (CI 15:3) was melt blended in a laboratory kneader for 30 minutes at 110° C. After cooling, this mixture was first roughly crushed and afterwards milled down by a jet mill (type 100AFG from Alpine) to a particle size of 8.8 μm. This product is named TC6. A mixture of 18 g TC6, 65 g of a 7% solution in Isopar L of a polystyrene(25)/butadiene(75) block polymeric stabilizer and 47 g of Isopar L was made. Wet grinding was effected in the same way as in Example 1. In this manner, a liquid developer having a volume average particle diameter of 1.56 μm, measured by disc centrifuge model DC 18000 of CPS Instruments Ltd., was prepared.

A liquid developer No. 6 was obtained by diluting the above concentrated liquid developer to 4% solids (w/w) with a 0.25% (w/w) lecithin solution (Stemprime N10 from Stern Co.) in Isopar L.

Example 7

A mixture of 85% of resin CP1 and 15% of a Cu-phthalocyanine blue pigment (CI 15:3) was melt blended in a laboratory kneader for 30 minutes at 90° C. After cooling, this mixture was first roughly crushed and afterwards milled down by a jet mill (type 100AFG from Alpine) to a particle size of 7.9 μm. This product was named TC7. A mixture of 18 g TC7, 45 g of a 10% solution In Isopar L of an isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.) and 62 g Isopar L was made.

Wet grinding was effected in the same way as in Example 1. In this manner, a liquid developer having a volume average particle diameter of 1.43 μm, measured by disc centrifuge model DC18000 of CPS Instruments Ltd., was prepared.

A liquid developer No. 7 was obtained by diluting the above concentrated liquid developer to 4% solids (w/w) with Isopar L.

Example 8

A mixture of 85% of resin CP3 and 15% of a Cu-phthalocyanine blue pigment (CI 15:3) was melt blended in a laboratory kneader for 30 minutes at 125° C. After cooling, this mixture was first roughly crushed and afterwards milled down by a jet mill (type 100AFG from Alpine) to a particle size of 9.5 μm. This product was named TC8. A mixture of 18 g TC8, 45 g of a 10% solution in Isopar L of an isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.) and 62 g Isopar L was made.

Wet grinding was effected in the same way as in Example 1. In this manner a liquid developer having a volume average particle diameter of 1.85 μm, measured by disc centrifuge model DC 18000 of CPS Instruments Ltd., was prepared.

A liquid developer No. 8 was obtained by diluting the above concentrated liquid developer to 4% solids (w/w) with Isopar L.

Example 9

A mixture of 30% of resin CP1, 55% of resin AP2, and 15% of a Cu-phthalocyanine blue pigment (CI 15:3) was melt blended in a laboratory kneader for 30 minutes at 110° C. After cooling, this mixture was first roughly crushed and afterwards milled down by a jet mill (type 100AFG from Alpine) to a particle size of 9.1 μm. This product was named TC9. A mixture of 18 g TC9, 45 g of a 10% solution in Isopar L of a isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.) and 62 g Isopar L was made.

Wet grinding was effected in the same way as in Example 1. In this manner, a liquid developer having a volume average particle diameter of 1.47 μm, measured by disc centrifuge model DC 18000 of CPS Instruments Ltd., was prepared.

A liquid developer No. 9 was obtained by diluting the above concentrated liquid developer to 4% solids (w/w) with Isopar L.

Example 10

A mixture of 85% of resin AP2 and 15% of a Cu-phthalocyanine blue pigment (CI 15:3) was melt blended in a laboratory kneader for 30 minutes at 110° C. After cooling, this mixture was first roughly crushed and afterwards milled down by a jet mill (type 100AFG from Alpine) to a particle size of 8.1 μm. This product was named TC10. A mixture of 18 g TC10, 45 g of a 10% solution in Isopar L of a isobutylmethacrylate(85)/stearylmethacrylate(15) copolymeric stabilizer (Neocryl B703 of Neoresins), 5 g Nuodex Zr12 (a zirconium soap of a naphthenic acid of Condea Co.) and 62 g Isopar L was made.

Wet grinding was effected in the same way as in Example 1. In this manner, a liquid developer having a volume average particle diameter of 1.51 μm, measured by disc centrifuge model DC18000 of CPS Instruments Ltd., was prepared.

A liquid developer No. 10 was obtained by diluting the above concentrated liquid developer to 4% solids (w/w) with Isopar L.

Example 11

A mixture of 85% of resin AP1 and 15% of a Cu-phthalocyanine blue pigment (CI 15:3) was melt blended in a laboratory kneader for 30 minutes at 115° C. After cooling, this mixture was first roughly crushed and afterwards finely crushed by a jet mill (type 100AFG from Alpine) to a particle size of 9.5 μm. This product was named TC11. A mixture of 18 g TC 11, 45 g of a 10% solution in Isopar L of a isobutylmethacrylate(85)/stearylmethacrylate (15) copolymeric stabilizer (Neocryl B703 of Neoresins), 5 g Nuodex Zr12 (a zirconium soap of a naphthenic acid of Condea Co.), and 62 g Isopar L was made. Wet grinding was effected in the same way as in Example 1. In this manner, a liquid developer having a volume average particle diameter of 1.39 μm, measured by disc centrifuge model DC 18000 of CPS Instruments Ltd., was prepared.

A liquid developer No. 11 was obtained by diluting the above concentrated liquid developer to 4% solids (w/w) with Isopar L.

Example 12

35% of Nucrell 599 (trade name of an ethylene/methacrylic acid copolymer of DuPont) and 65% of Isopar L were mixed for 60 minutes at 130° C. in a laboratory kneader. It was observed that the resin was fully dissolved in the dispersant, indicating a solubility of >2% w/w. Afterwards, 60 parts of this solvated polymer was charged in a sand mill together with 3 parts of Cu-phthalocyanine pigment (CI 15:3), 0.5 parts aluminum tristearate, and 36.5 parts of Isopar L. Wet grinding was effected in the same way as in Example 1 but the milling time was set at 10 hours instead of 2 hours. In this manner, a liquid developer having a volume average particle diameter of 2.39 μm, measured by disc centrifuge model DC 18000 of CPS Instruments Ltd., was prepared.

A liquid developer No. 12 was obtained by diluting the above concentrated liquid developer to 4% solids (w/w) with a 0.25% (w/w) lecithin solution (Stemprime N10 from the company Stern) solution in Isopar L.

Example 13

A mixture of 18 g TC1, 45 g of a 10% solution in Isopar L of a isobutylmethacrylate(85)/stearylmethacrylate(15) copolymetic stabilizer (Neocryl B703 of Neoresins), 5 g Nuodex Zr12 (a zirconium soap of a naphthenic acid of Condea Co.), and 62 g Isopar L was made. Wet grinding was effected in the same way as in Example 1, except that the milling time was set at 30 minutes instead of 2 hours. A liquid developer having a volume average particle diameter of 3.14 μm, measured by disc centrifuge model DC18000 of CPS Instruments Ltd., was prepared.

A liquid developer No. 13 was obtained by diluting the above concentrated liquid developer to 4% solids (w/w) with Isopar L.

Transfusing of Samples of Examples 1–13

The samples to be fixed were transfused in the transfuse setup, as described above. The results are reported in Table 5. Assessment is by the following ranking: 1=excellent, 3=acceptable, and 5=bad.

TABLE 5

| Liq. Dev. | | | Fusing speed | Tape test | | | | | |
|---|---|---|---|---|---|---|---|---|---|
| No. | Type | TC | (cm/s) | 65° C. | 80° C. | 95° C. | 110° C. | 120° C. | Tack |
| 1 | pref. embodiment | TC1 | 12.5 | 5 | 2 | 1 | — | — | 1 |
| 2 | pref. embodiment | TC2 | 12.5 | 4 | 3 | 1 | — | — | 2 |
| 3 | pref. embodiment | TC3 | 12.5 | 5 | 4 | 2 | 1 | 1 | 3 |
| 4 | limit | TC4 | 12.5 | 5 | 5 | 3 | 2 | 1 | 3–4 |
| 5 | pref. embodiment | TC5 | 12.5<br>25<br>37.5 | 5 | 3 | 1<br>1<br>1 | 1 | 1 | 2 |
| 6 | pref. embodiment | TC6 | 12.5 | 5 | 2 | 1 | 1 | — | 1 |
| 7 | pref. embodiment | TC7 | 12.5 | 3 | 2 | — | — | — | 1 |
| 8 | limit | TC8 | 12.5 | 5 | 5 | 5 | 3–4 | 2–3 | 1 |
| 9 | pref. embodiment | TC9 | 12.5 | 4 | 2 | 1 | — | — | 3 |
| 10 | comparative | TC10 | 12.5 | 5 | 5 | 3 | 2 | 1 | 5 |
| 11 | comparative | TC11 | 12.5 | 5 | 5 | 5 | 4 | 3 | 5 |
| 12 | comparative | Nucrell 599 | 12.5 | 5 | 5 | 5 | HO | — | 2 |
| 13 | pref. embodiment | TC1 | 12.5 | 5 | 2 | 1 | — | — | 1 |

From the data it is observed that neither pure amorphous material nor crystalline material with a solubility >2% w/w gives satisfactory results. The insoluble crystalline phase-containing materials give good results according to the preferred embodiments.

Examples 5 and 11 were repeated using a hot roller fusing device as described above. A marked improvement of the fusing behavior is found in Example 5 compared to the pure amorphous toner material. Results for fusing behavior are reported in Table 6. Assessment used the same rankings as in Table 5.

TABLE 6

| Liq. Dev. | | | tape test | | | |
|---|---|---|---|---|---|---|
| No. | Type | TC | 80° C. | 95° C. | 110° C. | Tack |
| 5 | Pref. Embodiment | TC5 | 1 | 1 | 1 | 2 |
| 11 | Comparative | TC11 | 5 | 3 | 2 | 5 |

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. All patents, applications, and other references cited herein, are hereby incorporated by reference in their entirety.

What is claimed is:

1. A liquid developer composition, the composition comprising:

a dispersant; and a toner comprising a colorant and a binder resin, the binder resin comprising a physical mixture of an amorphous polymer and a crystalline phase-containing polymer, wherein the crystalline phase-containing polymer has a melt energy greater than about 35 J/g, and wherein the crystalline phase-containing polymer has a solubility of less than about 2 g/l in the dispersant at a temperature 10° C. higher than a melting temperature of the polymer.

2. The liquid developer composition of claim 1, wherein the toner comprises 5 wt. % or more of the crystalline phase-containing polymer.

3. The liquid developer composition of claim 1, wherein the dispersant has a resistance greater than $10^{10}$ Ohm·m.

4. The liquid developer composition of claim 1, wherein a melting point of the crystalline phase-containing polymer is greater than or equal to about 65° C.

5. The liquid developer composition of claim 1, wherein a Tg of the amorphous polymer is greater than or equal to about 40° C.

6. The liquid developer composition of claim 1, wherein a melting point of the crystalline phase-containing polymer is lower than a softening point of the amorphous polymer.

7. The liquid developer composition of claim 1, wherein the crystalline phase-containing polymer comprises a polyester.

8. The liquid developer composition of claim 1, wherein the binding resin of the toner has a melting temperature greater than or equal to about 50° C.

9. The liquid developer composition of claim 1, wherein the amorphous polymer comprises a polyester.

10. The liquid developer composition of claim 1, wherein the amorphous polymer comprises a mixture of a polyester and a non-polyester.

11. The liquid developer composition of claim 1, wherein the colorant comprises an inorganic pigment.

12. The liquid developer composition of claim 1, wherein the colorant comprises an organic colorant.

13. The liquid developer composition of claim 1, wherein the toner further comprises a colloidal inorganic filler.

14. The liquid developer composition of claim 1, further comprising a steric stabilizer.

15. The liquid developer composition of claim 14, wherein the steric stabilizer comprises from about 5 wt. % to about 50 wt. % of the toner composition.

16. The liquid developer composition of claim 1, further comprising a charging agent.

17. The liquid developer composition of claim 16, wherein the charging agent is selected from the group consisting of oil soluble ionic surfactants, amphoteric surfactants, and ionic surfactants comprising organic acid metal salts.

18. The liquid developer composition of claim 1, wherein a particle size of the toner is from about 0.5 μm to about 5 μm.

19. A method for transfusing an image, the method comprising:

transferring a liquid developer onto a heated intermediate member, the liquid developer forming an image, wherein the liquid developer comprises a dispersant and a toner, the toner comprising a colorant and a binder resin, the binder resin comprising a physical mixture of an amorphous polymer and a crystalline phase-containing polymer, wherein the polymer has a melt energy greater than about 35 J/g, and wherein the crystalline phase-containing polymer has a solubility of less than about 2 g/l in the dispersant at a temperature 10° C. higher than a melting temperature of the polymer;

transferring the image from the heated intermediate member to a final substrate in a nip; and applying mechanical pressure and heat to the final substrate, whereby the image is transfused to the final substrate.

20. The method of claim 19, wherein the image is a color image.

21. The method of claim 19, wherein the step of applying mechanical pressure and heat to the final substrate is conducted at a fusing speed greater than or equal to about 10 cm/sec.

22. A liquid developer composition, the composition comprising:

a dispersant; and a toner comprising a colorant and a binder resin, the binder resin comprising a physical mixture of an amorphous polymer and a polymer composition, wherein the polymer composition has a crystallinity of greater than about 30 wt. %, wherein the polymer composition has a melt energy greater than about 10 J/g, and wherein the polymer composition has a solubility of less than about 2 g/l in the dispersant at a temperature 10° C. higher than a melting temperature of the polymer composition.

* * * * *